US006427125B1

(12) United States Patent
Gzara et al.

(10) Patent No.: US 6,427,125 B1
(45) Date of Patent: Jul. 30, 2002

(54) HYDRAULIC CALIBRATION OF EQUIVALENT DENSITY

(75) Inventors: Kais Gzara, Stafford; Iain Rezmer-Cooper, Sugar Land, both of TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/448,196

(22) Filed: Nov. 23, 1999

Related U.S. Application Data

(60) Provisional application No. 60/156,604, filed on Sep. 29, 1999.

(51) Int. Cl.[7] ..... G06F 19/00
(52) U.S. Cl. ..... 702/9; 703/6
(58) Field of Search ..... 702/9, 14; 175/24, 175/39; 703/6

(56) References Cited

U.S. PATENT DOCUMENTS

| | | | | |
|---|---|---|---|---|
| 4,785,300 | A | 11/1988 | Chin et al. | |
| 4,825,421 | A | 4/1989 | Jeter | |
| 4,839,870 | A | 6/1989 | Scherbatskoy | |
| 4,847,815 | A | 7/1989 | Malone | |
| 4,879,654 | A | 11/1989 | Bruce | |
| 5,073,877 | A | 12/1991 | Jeter | |
| 5,222,049 | A | 6/1993 | Drumheller | |
| 5,368,108 | A * | 11/1994 | Aldred et al. | 175/40 |
| 6,109,368 | A * | 8/2000 | Goldman et al. | 175/39 |
| 6,206,108 | B1 * | 3/2001 | MacDonald et al. | 175/24 |

FOREIGN PATENT DOCUMENTS

| | | |
|---|---|---|
| FR | 2 723 141 | 2/1996 |
| GB | 2 140 599 B | 2/1987 |
| GB | 2 347 447 | 6/2000 |
| WO | WO 95/14845 | 6/1995 |

OTHER PUBLICATIONS

Combined Search and Examination Report Under Sections 17 and 18 (3), Oct. 26, 2000, United Kingdom Patent Office.

Green, M.D. et al, "An Integrated Solution of Extended–Reach Drilling Problems in the Niakuk Field, Alaska: Part II—Hydraulics, Cuttings Transport and PWD", SPE Paper 56564, presented at the 1999 SPE Annual Technical Conference and Exhibition, held in Houston, Texas Oct. 3–6, 1999.

Monroe, S.P., "Applying Digital Data–Encoding Techniques to Mud Pulse Telemetry", SPE Paper 20326 presented at the Fifth SPE Petroleum Computer Conference, held in Denver, Colorado, Jun. 25–28, 1990, pp. 7–16.

* cited by examiner

*Primary Examiner*—Edward Lefkowitz
*Assistant Examiner*—Victor J. Taylor
(74) *Attorney, Agent, or Firm*—Brigitte L. Jeffery

(57) ABSTRACT

In a drilling system for drilling a well borehole from a surface location, hydraulic calibration is performed by making a plurality of hydraulic calibration measurements, each hydraulic calibration measurement being made at a respective drill-string RPM and flow-rate within a hydraulic calibration range. A hydraulic baseline function is then determined which predicts, within a predetermined degree of accuracy, each of the plurality of hydraulic calibration measurements.

10 Claims, 9 Drawing Sheets

501

Inputs

- Mud-weight ($\rho Mud,0$)
- Mud viscosity ($V\ Mud,0$)
- Casing shoe true vertical depth (TVDcs)
- Casing shoe measured depth (MDcs)
- Maximum RPM allowed ($RPM_{Max}$)
- Maximum Flow-rate allowed ($Q_{Max}$)
- Maximum Flow-rate to turn the MWD on ($Q_{MWD}$)
- Maximum safe ECD ($ECD_{Max}$)
- Accuracy required per point (EMax)

502

ECD Calibration

- Define $Q_2 = Max(\frac{Q_{Max}}{2}, Q_{MWD})$
- Define $RPM_2 = RPM_{Max} \times \frac{Q_2}{Q_{Max}}$
- Calibration at (0,0) followed by Calibration at $(RPM_2, Q_2) \rightarrow ECD_1$ and $ECD_2$
- Define $Q_{Safe} = Min(Q_{Max}, Q_2 \times \frac{ECD_{Max} - ECD_1}{ECD_2 - ECD_1})$
- Define $RPM_{Safe} = Min(RPM_{Max}, RPM_2 \times \frac{ECD_{Max} - ECD_1}{ECD_2 - ECD_1})$
- Calibration at $(RPM_{Safe}, Q_{Safe}) \rightarrow ECD_3$

Ⓐ

FIG. 5A-1

HYDRAULIC CALIBRATION OF EQUIVALENT DENSITY

CROSS-REFERENCE TO RELATED APPLICATIONS

This application claims priority under 35 U.S.C. § 119 to U.S. Provisional Patent Application Serial No. 60/156,604, filed on Sep. 29, 1999.

BACKGROUND OF THE INVENTION

1. Field of the Invention

The present invention relates to oil well drilling and, in particular, to more efficient calibration of equivalent circulating density (ECD) and other hydraulic measurements.

2. Description of the Related Art

In the development, completion, and operation of natural hydrocarbon (e.g. oil) reservoirs, various telemetric systems and techniques are employed to make downhole measurements readily available at the surface in real-time. In particular, MWD (measurements-while-drilling) and LWD (logging-while-drilling) techniques include any type of data transmission during drilling from sensor or detector units located within the well borehole. The borehole sensors may be located in the drill bit, in the bottom hole (or borehole) assembly (BHA), in the drill string above the mud motor, or in any other part of the sub-surface drill string. Present MWD/LWD telemetry systems employ drilling fluid or mud pulse telemetry, electromagnetic telemetry, or acoustic telemetry through the drill string itself, to transmit sensed data to the surface, and remain limited in bandwidth (data bit rates are typically in the 1 KHz range or lower).

Oil and gas wells are typically drilled with circulating drilling fluid systems. In such a system, drilling fluid, or "mud", is pumped from a reservoir at the surface of the earth down through the hollow drill string such that it exits the drill string at the drill bit and returns to the surface by way of the annulus between the borehole and the drill string. The drilling mud serves to maintain hydrostatic pressure within the borehole so that the internal pressure of formations penetrated by the bit is controlled, to provide a means of removing cuttings from the borehole and of conveying these cuttings to the surface of the earth. The drilling mud also serves to cool and lubricate the drill bit.

In mud pulse telemetry techniques, data from the downhole sensors is transmitted by means of a mud pressure pulse generator, which is part of the drill string. The generator generates pressure pulses in the drilling fluid or mud column, typically by way of a valve or siren type of device. This can only be done when there is a sufficient mud flow-rate (Q), when the pumps, which drive a circulating mud fluid, are on. Suitable generators used with MWD techniques are, for example, described in U.S. Pat. Nos. 4,785,300; 4,847,815; 4,825,421; 4,839,870 and 5,073,877.

The pulses are detected at the surface by suitable means, e.g., pressure sensors, strain gauges, accelerometers, and the like, which are usually directly attached to the drill string or the standpipe. Data may be transmitted to receivers and processors at the surface via alternate techniques as well, such as wireline tools via hard wired cables which contain electrical and/or fiber optic conductors which relay data to the surface (the wireline tools function would typically involve communicating with the nearby downhole MWD or LWD tools based on inductive coupling or other principles). Data transmission rates of conventional mud pulse telemetry systems are very low, e.g. 3 to 6 bits/sec, which is much lower than that of wireline systems.

One type of MWD measurement is annular pressure while drilling (APWD), which provides a downhole pressure measurement. In APWD, an annular sensor is provided that measures downhole annular pressure, and typically also temperature. These data readings or measurements are transmitted to the surface, e.g. by mud pulse telemetry. At the surface, a processor may be used to analyze the pressure data. When pressure is monitored in the context of other drilling parameters and in view of hydraulics principles, it is possible to identify undesirable drilling conditions, suggest remedial procedures, and help prevent serious problems from developing. Obtaining real-time downhole annular pressure information can be especially desirable in extended reach wells, high pressure/high temperature (HPHT) wells, in slim wells, and in deep water environments where large flowing frictional pressure losses or very narrow pressure margins can exist.

APWD pressure measurements can be also used to determine equivalent mud density, another useful downhole measurement. Equivalent density is typically referred to as equivalent circulating density (ECD), which is technically the equivalent mud density when the mud is circulating. When the mud is not circulating, equivalent density is referred to as equivalent static density (ESD). ECD is often used as a general term to encompass both ECD and ESD, and is an important parameter which represents the integrated measure of the fluid behavior in the annulus.

ECD is computed by dividing the measured pressure by true vertical depth (TVD), which is known at the surface. The ECD computed based on a given APWD pressure measurement may be referred to as an ECD measurement or measured ECD. If the measured CD is too high or too low, in comparison to some expected ECD, corrective or other responsive steps may be taken, to try to maintain the ECD within a desired range. For example, a higher ECD can indicate that cuttings are not being cleaned efficiently, and a lower ECD may indicate that a gas influx has occurred. Thus, it is useful to know ECD because it can help prevent costly drilling problems (mostly related to poor hole cleaning) and can aid in positively identifying kicks, inflows, and other events which can lead to unsafe drilling conditions.

Thus, by measuring pressure and determining ECD from this measurement, and by comparing this ECD measure to some baseline or expected ECD measure, corrective steps can be taken to maintain ECD within a desired range. This can help prevent lost circulation and maintain borehole integrity (including managing swab, surge, and gel breakdown effects). Similarly, it is also useful to monitor the downhole pressure measurements.

Hydraulic-related measurements such as downhole APWD pressure measurements and measurements derived therefrom, such as equivalent density, may be referred to generally as hydraulic measurements. In addition to ECD and downhole pressure, it is also useful to measure and monitor other hydraulic measurements, such as standpipe pressure, internal pressure, and Turbine RPM (TRPM). TRPM is the RPM of a downhole turbine that generates electricity as mud flows therethrough. This electricity is often used to power downhole tools. Internal pressure is the pressure inside the drillpipe, and is typically measured by an Internal Pressure While Drilling (IPWD) sensor, for the purpose of detecting drill-pipe leaks and their position. An IPWD sensor is typically identical to an APWD sensor, but instead of being in the annulus it is inside the drillpipe.

Hydraulic measurements such as downhole pressure and ECD, however, are sensitive to a variety of events and factors. Thus, in order to diagnose events and analyze real-time hydraulic measurements which are taken under certain prevailing conditions, there is a need to account for as many of the factors as possible. Under current technology, sophisticated modeling or simulation is not sufficient for such analysis, because some of the factors that affect pressure measurements cannot be easily predicted or modeled. Factors which affect pressure measurements include mud properties (including changes related to pressure and temperature), flow-rate, flow-regime, drill-string rotations per minute (RPM), drill-pipe eccentricity, and hole geometry (size and shape).

Both RPM and the flow-rate are known at the surface. However, because the other factors that affect the pressure measurement and thus the nominal ECD calculation are unpredictable and not always known or knowable at the surface, there is a need to calibrate the hydraulic measurement in-situ, i.e. to establish a base which indicates what the hydraulic measurement (e.g., downhole pressure or ECD) should be for a given flow-rate Q and drill-string RPM. The terms "ECD Calibration", "Hydraulic Calibration", and "Hydraulic Fingerprinting" are commonly used to describe such a calibration.

Hydraulic calibration refers to taking hydraulic measurements under different flow-rates and RPMs, so that subsequent real-time hydraulic measurements at given flow-rates and RPMs can be compared to the expected or baseline hydraulic measurement under the prevailing flow-rate and RPM. For example, in ECD calibration in particular, ECD calibration measurements or data points are taken under different flow-rates and RPMs, to build a database that indicates what ECD measurement should be expected at a given flow-rate and drill-string RPM. Subsequent real-time ECD measurements at given flow-rates and RPMs can thus be compared to the expected or baseline ECD found in the database.

Conventional ECD calibration is carried out in a random fashion, by measuring APWD directly at the casing shoe under a random range of different flow-rates and drill-string RPMs to provide a plurality of ECD calibration measurements. Referring now to FIG. 1, there is shown a conventional rectangular hydraulic matrix 100 used for ECD calibration. As illustrated, several ECD readings or measurements are taken, at a variety of RPMs and flow-rates, e.g. $ECD_{11}$, and so forth. Each such measurement of an ECD calibration point may be referred to as a calibration. The calibration points are then used in a look-up table (LUT). Each ECD measurement made subsequently in real-time during drilling is compared to the ECD stored in the LUT at the RPM and flow-rate closest to the prevailing RPM and flow-rate in use during the ECD measurement. Interpolation "by eye" is also used in addition to using the nearest value. One prior art ECD calibration approach is described in M. D. Green et al., "An Integrated Solution of Extended-Reach Drilling Problems in the Niakuk Field, Alaska: Part II Hydraulics, Cuttings Transport and PWD", SPE 56564, presented at the 1999 SPE Annual Technical Conference and Exhibition, Houston, Tex., USA, Oct. 3–6, 1999.

There are several drawbacks with conventional ECD and other hydraulic calibration approaches. First, the various flow-rates and RPMs selected for the ECD calibration typically consists solely of a rectangular matrix of calibration points, as illustrated in FIG. 1. This may result in unnecessary ECD calibration point measurements being made, for example if a rectangular shape is not optimal. Second, in this technique, it is not clear how many different flow-rates and RPMs are necessary to build the hydraulic matrix. A 3×3 matrix may be too small, but a 9×9 may be too large, for example. Thus, sometimes too many ECD measurements are made in an attempt to ensure that enough ECD data points are gathered to be able to establish an ECD baseline for arbitrary subsequent flow-rates and RPMs.

Moreover, a given rectangular matrix is typically developed for specific mud properties and a specific hole geometry, and is used without change as drilling proceeds, even if hole geometry changes and/or the mud properties change somewhat. This limits the usefulness of the ECD calibration points under dynamic drilling conditions.

Another drawback is that some of the ECD calibration points are not always available in real time, i.e. during the calibration procedure itself, because the flow-rate for some of the readings is insufficient to enable mud pulse telemetry. The lowest flow-rate sufficient to turn on mud pulse telemetry may be referred to as $Q_{MWD}$. A flow-rate which is insufficient for mud pulse telemetry may be referred to as a "low" flow-rate (i.e., $Q<Q_{MWD}$); a flow-rate which is sufficient to enable mud pulse telemetry may be referred to as a "high" flow-rate (i.e., $Q>Q_{MWD}$). Thus, for ECD calibration points measured at low flow-rates, such as $ECD_{11}$ of matrix 100, the measured ECD is stored in memory or log of the APWD tool and cannot be accessed until the APWD tool and BHA are pulled out of the hole (POOH) back to the surface, or unless a wireline or other tool is run inside the drill pipe to access the memory data. For these reasons, conventional ECD calibrations are time-consuming (e.g., up to two hours), waste valuable rig time, and/or are costly.

There is, therefore, a need for improved techniques for hydraulic calibration, including ECD calibration, which avoid the drawbacks of the prior art.

SUMMARY

In the present invention, hydraulic calibration is performed in a drilling system for drilling a well borehole from a surface location. A plurality of hydraulic calibration measurements are made, each hydraulic calibration measurement being made at a respective drill-string RPM and flow-rate within a hydraulic calibration range. A hydraulic baseline function is then determined which predicts, within a predetermined degree of accuracy, each of the plurality of hydraulic calibration measurements.

BRIEF DESCRIPTION OF THE DRAWINGS

FIGS. 5A–1–5A–3 are a flow chart illustrating the ECD calibration method of the present invention;

DESCRIPTION OF THE PREFERRED EMBODIMENT

In the present invention, an efficient hydraulic calibration technique is provided to more quickly and accurately derive a hydraulic measurement baseline function for use in subsequent hydraulic measurement while drilling. As described in further detail below, a selected number of calibration points are used, which are strategically positioned to maximize data and coverage of the expected range at a minimum number of points.

Further, the chronological order in which the calibration points are measured is an alternating order in which each calibration point made at a low flow-rate is followed by one at a high flow-rate so that pairs of calibration points may be transmitted to the surface in real-time, thus avoiding delays, or the necessity and costs of using a wireline transmission.

An improved technique for fitting a baseline function or curve to the calibration points is also provided herein. The hydraulic calibration of the present invention is described in detail below with respect to ECD calibration. For ECD calibration, the goal is to find a relationship of the form ECD=F(RPM,Q) with a sufficiently close fit to all measured ECD calibration points.

Oil Rig System

Figure 2:
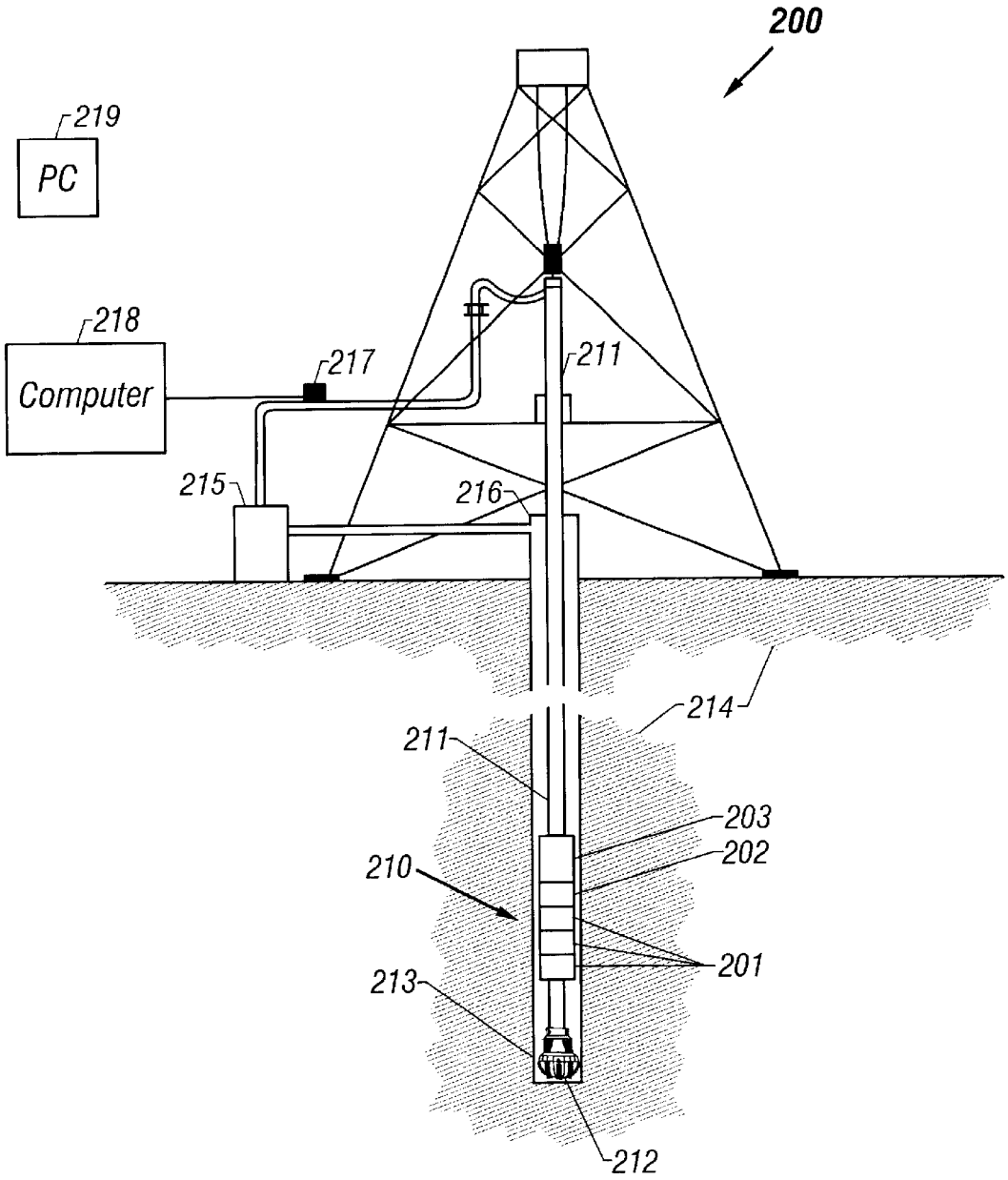
FIG. 2 is a schematic view of an oil rig having an APWD tool and surface-based processing equipment for performing ECD calibration, in accordance with an embodiment of the present invention.

Referring now to FIG. 2, there is shown a schematic view of an oil rig system 200 having an APWD tool and surface-based processing equipment for performing ECD calibration, in accordance with an embodiment of the present invention. Oil rig system 200 has an APWD tool 210 connected in a drill string 211 having a rotary drill bit 212 coupled to the end thereof and arranged for drilling a borehole 213 through earth formations 214.

As drill string 211 is rotated by the drilling rig, substantial volumes of drilling fluid ("drilling mud") are continuously pumped by mud pump or pumps 215 down through drill string 211 and discharged from bit 212 to cool and lubricate the bit and carry away cuttings removed by the bit. The mud is returned to the surface along the annular space 216 existing between the walls of the borehole 213 and the exterior of the drill string 211. This circulating stream of mud can be used for the transmission of a pressure pulse signal from APWD tool 210 to the surface.

APWD tool 210 is part of an MWD or LWD tool, and is an integral part of the drill-string. APWD tool 210 measures annular pressure and temperature with APWD sensors 201. In addition to downhole pressure and temperature measured by APWD sensors 201, other sensors of the MWD or LWD tool which comprises APWD tool 210 may measure parameters such as direction and inclination of the hole, gamma radiation, weight and torque on bit, downhole resistivity or conductivity of the drilling mud or formation, neutron spectroscopy, and the like. In an alternative embodiment, the APWD tool 210 measures only pressure but not temperature. The downhole pressure and other environmental and drilling measures detected by sensors 201 and other sensors (not shown) are encoded by encoders 202, which condition the electrical sensor signals representative of the measured data for transmission via mud pulse telemetry signals to the surface.

Electrical power for the operation of the MWD tool and APWD tool 210 is provided by a electrical power from a battery and/or the downhole turbine. Tool 210 also includes a modulator, or mud siren, 203 which selectively interrupts or obstructs the flow of the drilling mud through the drill string in order to produce pressure pulses in the mud, thereby transmitting modulated signals to the surface.

Modulator 203 is controlled such that the pressure pulses are produced in the form of encoded acoustic data signals which correspond to the encoded signals from the measuring devices 201. These signals, typically in the form of binary coded sequences, are transmitted to the surface by way of the mud flowing in the drill string. Any suitable signal modulation technique may be used. A number of possible modulation schemes for acoustic borehole telemetry are described by S. P. Monroe, "Applying Digital Data-Encoding Techniques to Mud Pulse Telemetry", Proceedings of the 5th SPE Petroleum Computer Conference, Denver, Jun. 25th–28th, 1990, SPE 20326, pp. 7–16.

When these signals reach the surface, they are detected and decoded by a suitable signal detector, e.g. an electro-mechanical transducer such as standpipe pressure transducer (SPT) 217. Transducers suitable for a acoustic signal/pressure conversion into electrical signals are also found in the published UK Patent GB-A-2 140 599, in U.S. Pat. No. 5,222,049, and in the published International Patent Application WO-A-95/14 845.

The analog signal of SPT 217 is appropriately filtered and sampled at an appropriate frequency to derive a digitally coded representation of the analog signal, which then can be further processed by computer 218, which may be a dedicated or general-purpose computer having a suitably-programmed processor. In particular, APWD sensors 201 provide a pressure reading or measurement, which is transmitted via mud pulses by modulator 203 to SPT 217, which provides a digital representation of this data to computer 218. In an embodiment, computer 218 receives pressure data and converts it to ECD data. The pressure, ECD, and other data is stored or logged in memory and also displayed on a monitor or other display means for viewing by an operator.

Selection and Positioning ECD Calibration Points

In the present invention, ECD calibration points are selected and positioned so as to minimize the number of ECD measurements that need to be made from which to derive an ECD baseline function. The ECD baseline function indicates what the ECD should read in the absence of cuttings or other unexpected conditions, for a given RPM and flow-rate.

Figure 3A:
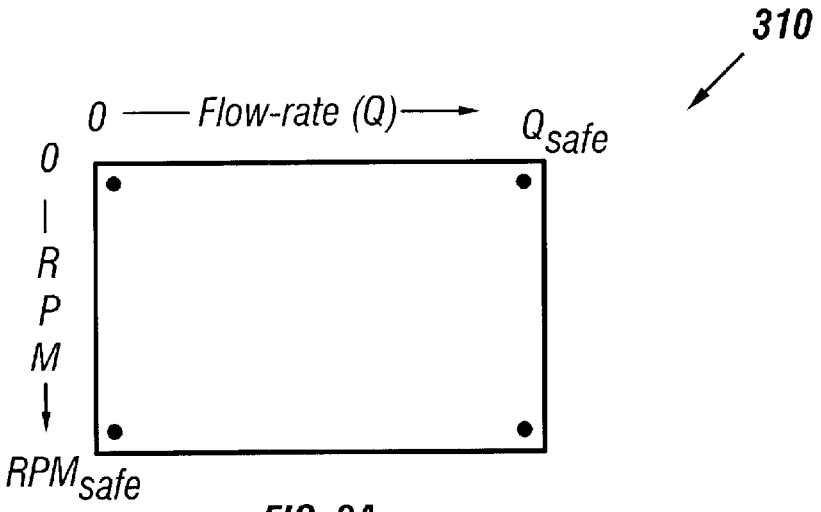
FIGS. 3A–C illustrate the selection of ECD calibration points of the ECD calibration of the present invention.
Figure 3B:
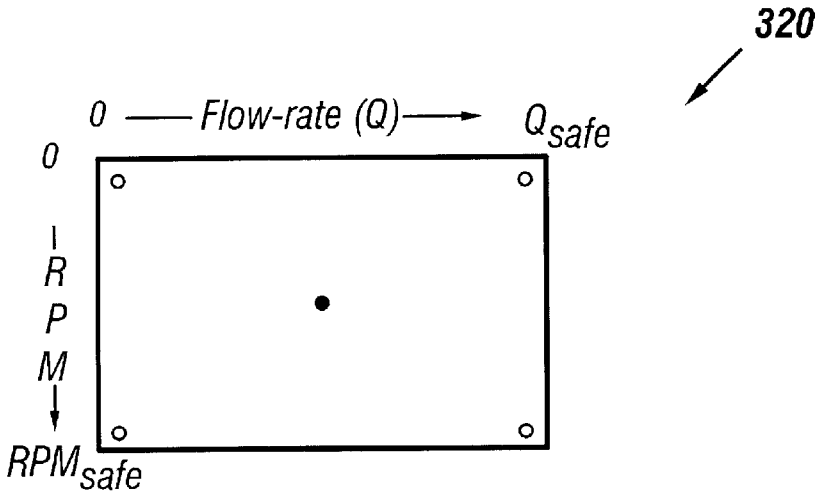
Figure 3C:
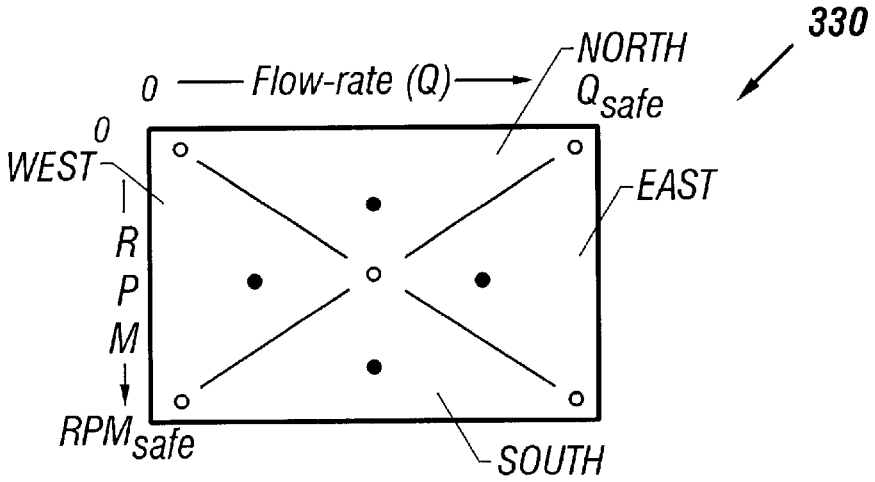

Referring now to FIGS. 3A–C, RPM versus flow-rate graphs are shown that illustrate the selection of ECD calibration points of the ECD calibration of the present invention. The maximum safe RPM ($RPM_{SAFE}$) and maximum safe flow-rate ($Q_{SAFE}$) are determined, to establish the outer bounds of any ECD calibration point measurements that need to be made. These safe points are selected, as described in further detail below with reference to steps 501–502 of FIG. 5A, to be the RPM and flow-rate combination at which some maximum tolerable ECD ($ECD_{MAX}$) will result.

Empirical results have shown that, in one embodiment, the optimum number of points needed for an ECD calibration does not exceed nine, if the outer calibration bounds and "center of gravity" approach described herein are employed. After all nine points are measured in accordance with the present invention, a successful fit should be able to be achieved. A successful fit may be achieved earlier, however, at as few as the first three measurements.

As shown in FIG. 3A, the origin (0,0) plus the $RPM_{SAFE}$ and $Q_{SAFE}$ points define an area bounded by four boundary points: (0,0), ($Q_{SAFE}$,0), (0,$RPM_{SAFE}$), ($Q_{SAFE}$,$RPM_{SAFE}$). These first four ECD calibration points $ECD_1$,$ECD_2$,$ECD_3$, $ECD_4$ delimit the calibration range, i.e. all calibration points will be measured within this calibration range. To obtain the "best coverage" of this area with the minimum of calibration points, another ECD calibration point ($ECD_5$) should be located at the "center of gravity" of this area, as shown in FIG. 3B. This point will be at or near the center of gravity of the calibration range, i.e. at ($Q_{SAFE}/2$,$RPM_{SAFE}/2$).

The first five calibration points define four areas as shown in FIG. 3C, which may be designated north, south, east, and west areas or sub-areas of the calibration grid. Each of these can be best covered by a respective ECD calibration point ($ECD_6$, $ECD_7$, $ECD_8$, $ECD_9$) located in the center of gravity of each sub-area or sub-region, respectively. Each of the four sub-areas could be subdivided further, in alternative embodiments, with subsequent calibration points, but empirical results have shown that nine calibration points are sufficient to permit a function with a good fit to the data to be found.

Ordering of ECD Calibration Points

In an embodiment of the present invention, APWD tool 210 operates as follows. APWD tool 210 continually makes pressure measurements and stores the pressure measurements in its local memory, during both low and high flow-rates. The process of turning on pump 215 at a given flow-rate and RPM and making such pressure measurements may be referred to as a measurement phase. During such a measurement phase, the consecutive pressure readings measured will tend to settle down (or up), e.g. in exponential fashion, from initial measurements down (or up) to more stable measurements. Thus, the last pressure measurement made near the end of a measurement phase will be a stable pressure measurement, provided that the measurement phase lasts long enough to permit stabilization of the measurements. The final stable pressure measurement is the one desired for calibration purposes.

During high flow-rates, each consecutively measured pressure measurement is stored in the memory and also transmitted to the surface via mud pulse telemetry. During low flow-rates, however, no data is transmitted to the surface via mud pulse telemetry. However, at the end of a low flow-rate measurement phase, the APWD tool memory is programmed to contain the final stable pressure measurement corresponding to that measurement phase.

In an embodiment of the present invention, APWD tool 210 is configured so that, at the beginning of a measurement phase at a high flow-rate, the tool first transmits to the surface an initial frame of data containing the final stable pressure measurement from the preceding low flow-rate measurement phase, as stored in memory. Thus, upon turn-on of pump 215 at a flow-rate sufficient to permit mud pulse telemetry, the APWD tool automatically transmits the previously stored data frame, followed by the resumption of current real-time pressure measurement and transmission.

The pressure measurements made during the current, high flow-rate measurement phase will tend to settle down or stabilize, and one of the transmitted current pressure measurements near the end of the current high flow-rate measurement phase may be utilized at the surface as the stable pressure measurement for the current measurement phase. In an embodiment, the last pressure measurement made during the current high flow-rate measurement phase is utilized as the stable pressure measurement for this measurement phase, because the stable low flow-rate pressure measurement transmitted with the initial data frame will be the last pressure measurement made during the preceding low flow-rate measurement phase.

Thus, in the present invention, ECD/pressure measurements are ordered so that each low flow-rate measurement phase is followed by a high flow-rate measurement phase. This ensures that all pressure measurements, both at low and high flow-rates, are transmitted to the surface in real time, during the measurement process. The present invention therefore permits downhole pressure measurements to be made even at low flow-rates, so long as a high flow-rate measurement follows each low flow-rate measurement.

In practice, ECD measurements are taken by alternating between low and high flow-rate measurement phases. This ensures that each pressure or ECD measurement made at a low flow-rate is followed by a measurement at a high flow-rate, so that APWD tool 210 transmits both the stored pressure measurement and current pressure measurements. The ECD calibration points are, accordingly, ordered to permit the transmission of pressure measurements in real time, one from the previous pressure measurement stored in memory and made at a low flow-rate, and current pressure measurements made at the current high flow-rate.

Figure 4:
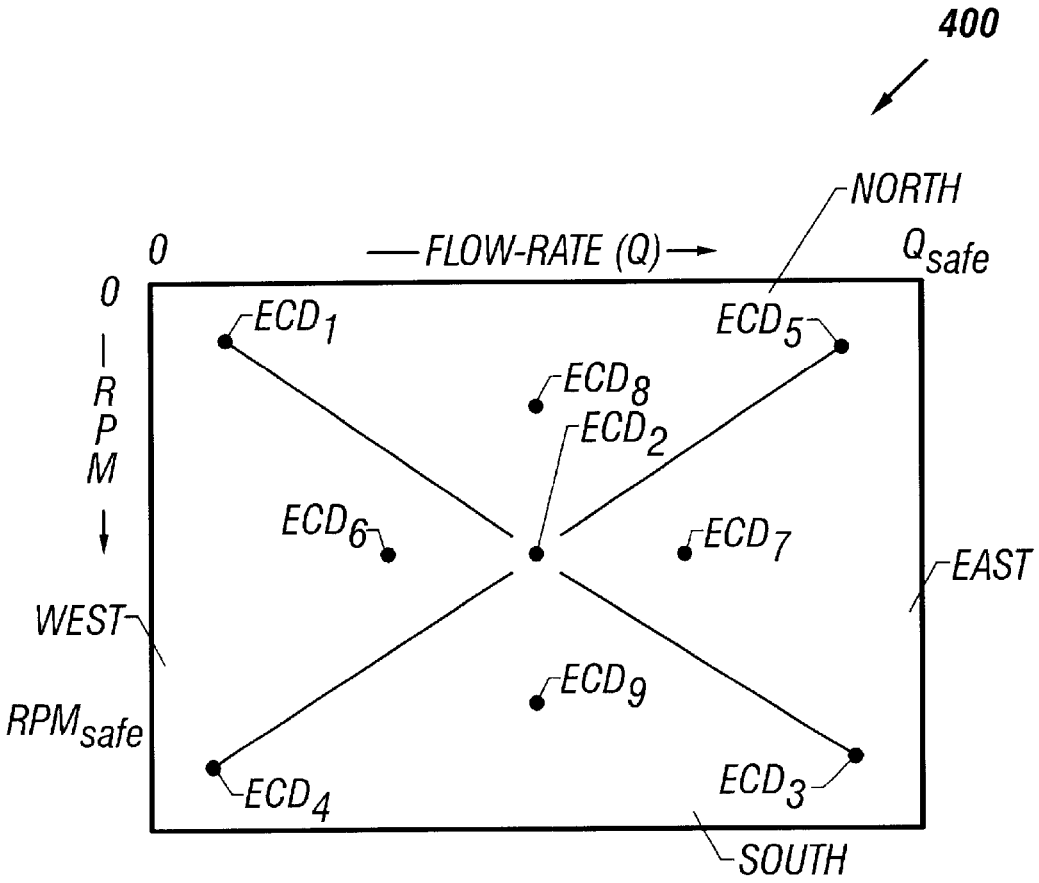
FIG. 4 illustrates the ordering of the ECD calibration points of FIGS. 3A–C.

Referring now to FIG. 4, there is illustrated the ordering of the ECD calibration points of FIGS. 3A–C, in accordance with an embodiment of the present invention. This ordering ensures that each ECD calibration point at a low flow-rate is followed by an ECD calibration point at a high flow-rate. For example, a first pressure measurement made during a low flow-rate measurement phase is stored in the APWD tool local memory at the end of the low flow-rate measurement phase. In the next (high flow-rate) measurement phase, this first calibration pressure measurement is transmitted to the surface at the beginning of the high flow-rate measurement phase, followed by each current pressure measurement, including the final current pressure measurement which may be used at the surface as the stable calibration pressure measurement for the current measurement phase. Thus, for each high flow-rate measurement phase following a low flow-rate measurement phase, two stable pressure measurements are received at the surface. These two stable pressure measurements are converted to ECD measurements by computer 218, as described above.

Figure 1:
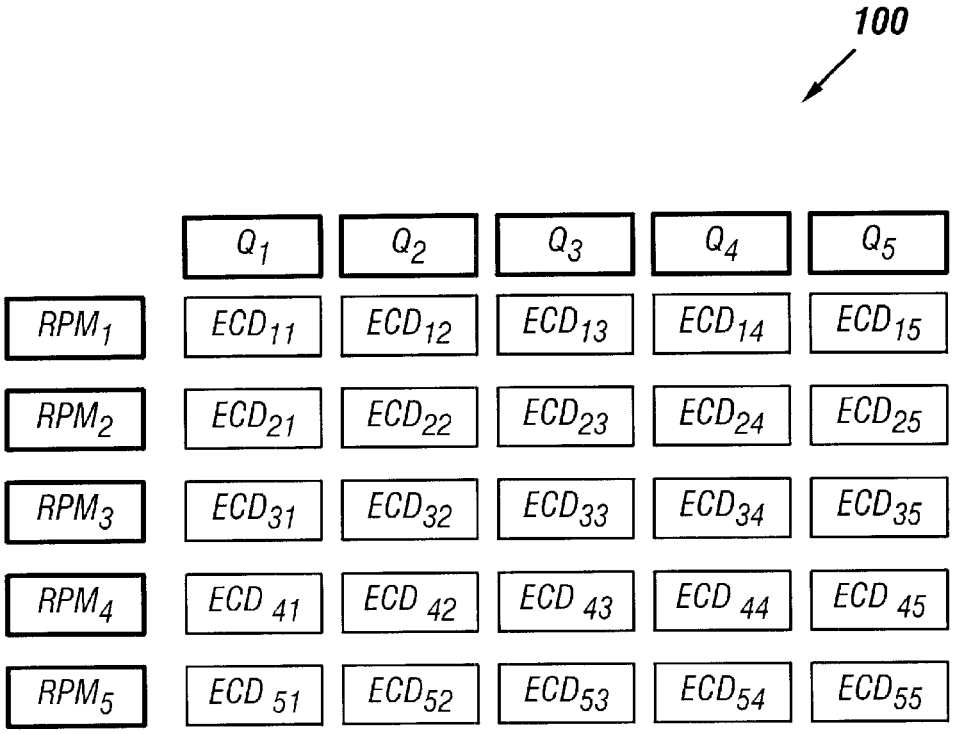
FIG. 1 (Prior Art)
FIG. 1 is an exemplary conventional rectangular hydraulic matrix used for ECD calibration in the prior art.
Figures 2, 5A:
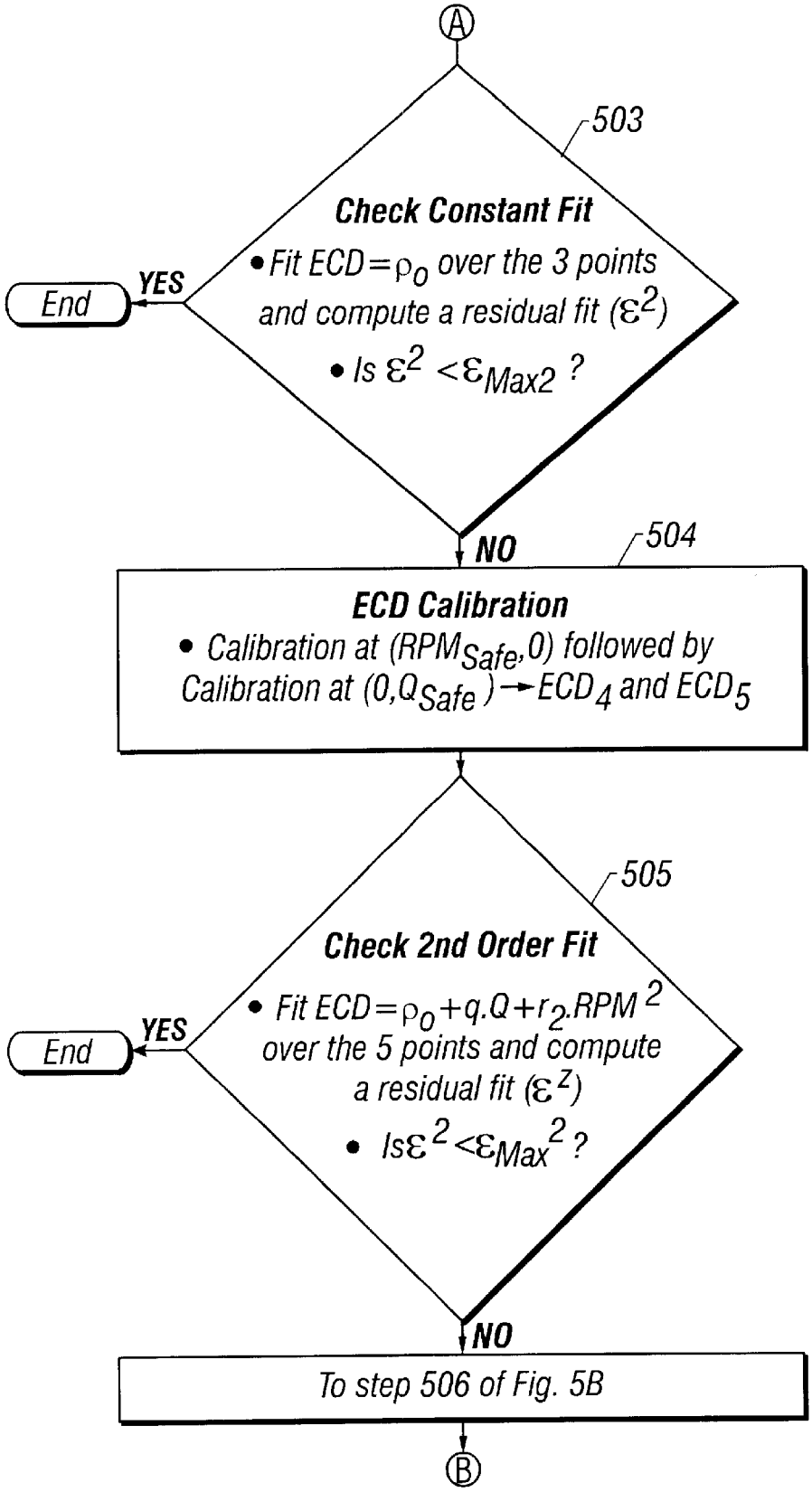
Figures 3, 5A:
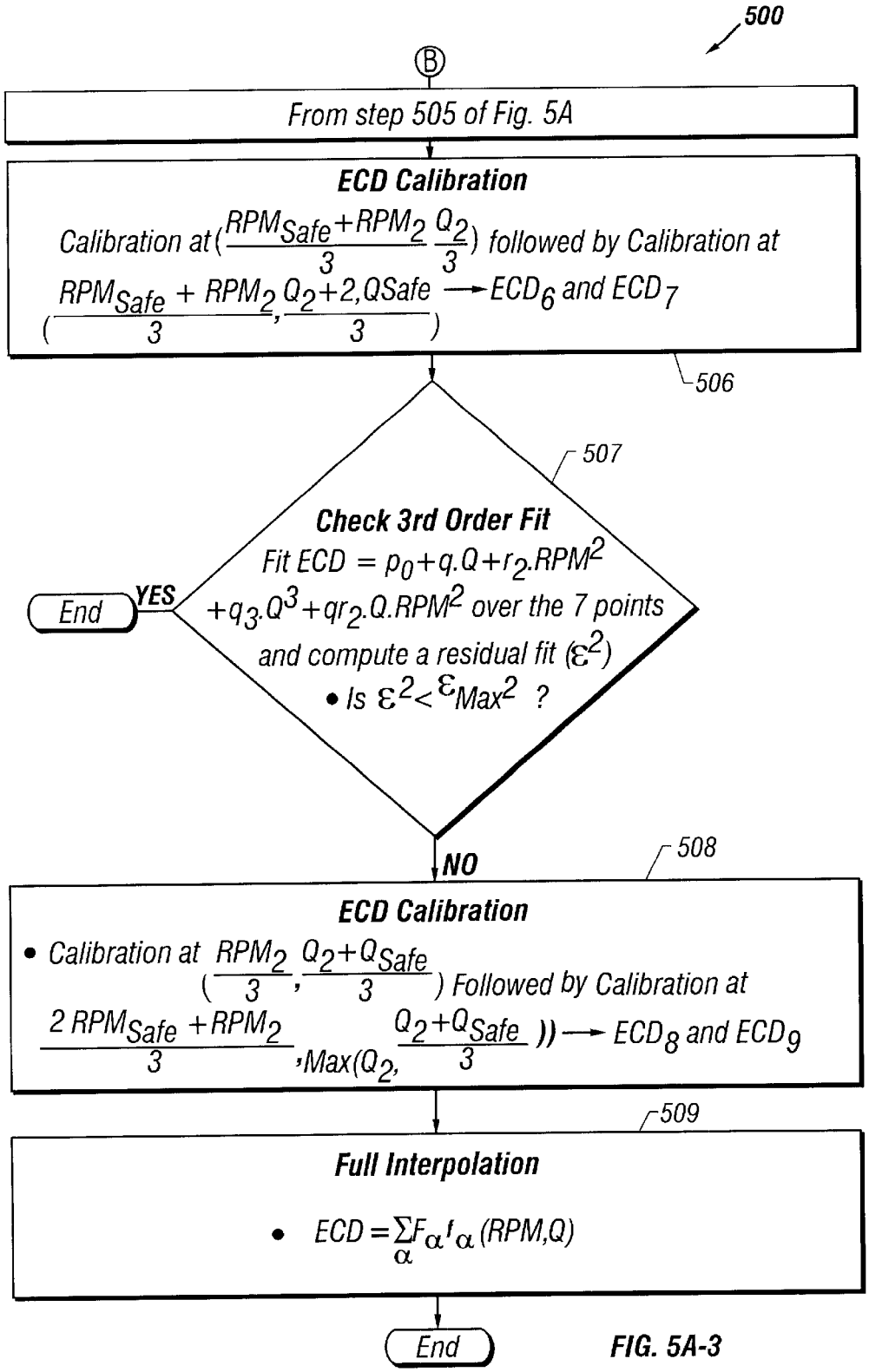

In an embodiment, therefore, the nine ECD calibration points are ordered as shown in FIG. 4. ECD calibration points $ECD_1$ and $ECD_2$ are measured first, before $Q_{SAFE}$ and $RPM_{SAFE}$ are determined, because these measurements are used to set $Q_{SAFE}$ and $RPM_{SAFE}$, i.e. the exact boundaries of the calibration range. $ECD_3$ is measured by itself, followed by the remaining ECD measurements, which are measured in pairs. Referring now to FIGS. 5A–1–5A–3, there is shown a flow chart illustrating the ECD calibration method 500 of the present invention.

To begin the calibration phase, a variety of input parameters are collected, as shown in step 501 and as defined in the section below entitled "Definitions", including the maximum permissible flow-rate ($Q_{MAX}$), the maximum permissible RPM ($RPM_{MAX}$), the maximum tolerable ECD ($ECD_{MAX}$), and $Q_{MWD}$. These parameters are used to determine the position of $ECD_2$, i.e. to determine $RPM_2$ and $Q_2$. The input data of step 501 may be input into a suitable ECD calibration program, such as a spreadsheet program, running on PC 219.

These parameters may be determined, for example, by asking a client or operator of the oil rig what maximum parameters can be tolerated. For example, ECD. is the maximum ECD that the client agrees to, to prevent "hydraulic" damage. This corresponds to the (RPM,Q) combination that ensures that ECD will not exceed the fracture gradient at the shoe. Similarly, $RPM_{MAX}$ and $Q_{MAX}$ are the maximum RPM and Q that the client agrees to, to prevent "mechanical" damage. For example, $RPM_{MAX}$ and $Q_{MAX}$ are the maximum RPM and Q that can be handled by the rig equipment, the casing, or the hole. The accuracy required for the ECD baseline function is designated as $\epsilon_{max}$ This may be specified in pounds per gallon (ppg), e.g. $\epsilon_{max}$ may be ±0.1 ppg. This specifies the accuracy with which a function ECD=F(RPM,Q) predicts each of the ECD calibration points measured.

Ideally, $ECD_2$ should be selected to be in the center of gravity of the calibration range defined by $Q_{SAFE}$ and $RPM_{SAFE}$; however, these points are not yet known. Thus, $RPM_2$ and $Q_2$ are selected as follows. First, as shown in step 502, $Q_2$ is selected to be the higher of $Q_{MWD}$ and half of the maximum permissible flow-rate $Q_{MAX}$, i.e., $Q_2=MAX(Q_{MAX}/2, Q_{MWD})$. This ensures that $Q_2$ will be at least high enough to turn on mud-pulse telemetry, and even higher if necessary to be closer to the middle of the range defined by $Q_{MAX}$. $RPM_2$ is located proportionately between 0 and the maximum permissible RPM ($RPM_{MAX}$) in accordance with the proportionate location of $Q_2$ along its axis, i.e. $RPM_2=RPM_{MAX}\cdot(Q_2/Q_{MAX})$.

Once the position of calibration point $ECD_2$ has been established, calibration points ECD, and $ECD_2$ are measured (calibrated). ECD calibration point ECD, at the origin is measured first, at a flow-rate of Q=0, which is of course a low flow-rate insufficient to enable mud-pulse telemetry. Thus, when the pump 215 is turned off, the pressure measurement is stored in memory in APWD tool 210. Next, the pump 215 is turned on at a flow-rate $Q_2$ and at $RPM_2$ to measure ECD calibration point $ECD_2$, where $Q_2$ is guaranteed to be a high flow-rate. During the measurement for calibration point $ECD_2$, the APWD tool first transmits the pressure reading corresponding to point $ECD_1$ to computer 218 at the surface. The APWD tool then goes on transmitting current pressure readings to the surface, one of which (e.g., the last) will be selected at the surface to correspond to $ECD_2$. Computer 218 converts these two calibration pressure readings into ECD measurements for calibration points $ECD_1$ and $ECD_2$.

The ECD readings for points $ECD_1$ and $ECD_2$ are then analyzed to select $Q_{SAFE}$ and $RPM_{SAFE}$ to optimally delimit the exact calibration range, as shown in step 502. These calibration points are determined by computer 218, which converts the corresponding pressure measurements into ECD measurements and, for example, displays the results on a monitor or display means. The displayed ECD measurement shown on the display of computer 218 are entered into a suitable application, such as a spreadsheet program, running on a computer, such as laptop PC 219, which determines what RPM and flow-rate should be set and used for the next ECD measurement or measurements.

In an embodiment, a first order assumption is made that ECD is linear in Q and RPM, solely for the purpose of predicting $Q_{SAFE}$ and $RPM_{SAFE}$. Therefore, having two calibration points [(0,0), ($Q_2$,$RPM_2$)] and the two corresponding ECD values ($ECD_1$ and $ECD_2$), we can extrapolate linearly what ($Q_{SAFE}$, $RPM_{SAFE}$) will result in $ECD_{MAX}$. An additional constraint requires that $Q_{SAFE}$ and $RPM_{SAFE}$ cannot exceed $Q_{MAX}$ and $RPM_{MAX}$, respectively. Thus:

$$Q_{SAFE}=MIN[Q_{MAX},\{Q_2\cdot(ECD_{MAX}-ECD_1)/(ECD_2-ECD_1)\}]$$

$$RPM_{SAFE}=MIN[RPM_{MAX},\{RPM_2\cdot(ECD_{MAX}-ECD_1)/(ECD_2-ECD_1)\}]$$

At this point, the calibration range is determined. Calibration point $ECD_2$ will be at or at least near the center of gravity of this range, i.e.:

$$Q_2=MAX(Q_{MAX}/2,Q_{MWD})Q_{SAFE}/2;$$

$$RPM_2=RPM_{MAX}\cdot(Q_2/Q_{MAX})RPM_{SAFE}/2.$$

Next, ECD calibration point $ECD_3$ is measured at $Q_3=Q_{SAFE}$ and $RPM_3=RPM_{SAFE}$. This is at a high flow-rate (because $Q_{SAFE}/2$ is guaranteed to be greater than or equal to $Q_{MWD}$). Therefore, ECD measurements for calibration points $ECD_1$, $ECD_2$, and $ECD_3$ are available at the surface after calibration point $ECD_3$ is measured.

At this point, as shown in step 503, a suitable curve-fitting program, such as a properly configured spreadsheet, running on a computer such as PC 219 attempts to find a function (ECD baseline curve or function) that fits these three calibration points to within a specified degree of accuracy. This may be done by entering into PC 219 the ECD calibration points measured so far and displayed by computer 218. If the residual fit or error $\epsilon^2<\epsilon_{MAX}^2$, then the ECD baseline function developed based on these three points can be utilized and the calibration procedure can be terminated. This ECD baseline function is then used during subsequent drilling for analysis purposes.

Otherwise, the next two calibration points $ECD_4$, $ECD_5$ are measured (step 504) and a second order fit is attempted (step 505). Again, if the curve produced by the ECD baseline function fits the five calibration points to within specified degree of accuracy, the calibration procedure can stop; otherwise, the next two points ($ECD_6$ and $ECD_7$) are measured (step 506) and another (third-order) curve fit is attempted (step 507). If the ECD baseline function fits these seven calibration points to within the specified degree of accuracy, the calibration procedure can stop; otherwise, the final two points ($ECD_8$ and $ECD_9$) are measured (step 508) and then full interpolation is performed (step 509), which is expected to result in a suitable ECD baseline function.

Thus, in an embodiment, each time ECD data measurements are made and received at the surface, following the first three ECD measurements, an attempt is made to generate a function that fits the data measured so far. Thus, such an attempt is made after point $ECD_3$; after points $ECD_4$ and $ECD_5$; after points $ECD_6$ and $ECD_7$; and again after points $ECD_8$ and $ECD_9$ have been measured or calibrated. In general, when carrying out ECD calibration, the goal is to find a relationship of the form ECD=F(RPM,Q) with a sufficiently close fit to the measured ECD calibration point. The curve fitting technique and corresponding equations employed in the present invention are described in further detail below in the section entitled "ECD Baseline Curve Fitting".

Whichever curve fitting technique is utilized, the ECD calibration points developed in accordance with the present invention, as described above, provide several advantages over conventional ECD calibration techniques. The ECD calibration points of the present invention provide better data points with which to fit a curve than a simple "brute force" type rectangular matrix. Moreover, fewer points are necessary because they are selected to provide adequate coverage of the calibration range by strategically placing the ECD points at the centers of gravity of the various areas into which the calibration range is subdivided by the vertices of the ECD points. Furthermore, by alternating between low flow-rate and high flow-rate points in a system that permits one prior frame of data stored in memory to be transmitted along with current data, during a high Q measurement, the ECD measurements may be obtained in real time, without having to POOH the BHA or run a wireline tool to access data stored in memory. Further, because of the intelligent selection of ECD points and the attempt to fit a curve to points each time a new pair of data points are received, the ECD calibration may be terminated in some cases even before all nine measurements are made.

In alternative embodiments, different ordering of the ECD calibration points may be utilized, so long as each point at a low flow-rate is followed by a point at a high flow-rate.

ECD Baseline Curve Fitting

As described above, the ECD baseline function which is derived from the measured ECD calibration points is of the form ECD=F(RPM,Q). To establish such a relationship, a polynomial fit is attempted. However, the inventors have discerned that the direction of RPM is irrelevant to such a fit, as far as annular friction pressure losses are concerned; and reversing the direction of flow merely changes the sign of the annular friction pressure losses.

Accordingly, in an embodiment of the invention, the function F(RPM,Q) is subject to the constraint that it must be even in RPM and odd in Q, except for any residual constant, which is even in RPM and independent of Q. If odd powers of RPM are utilized, for example, the function F(RPM,Q) would not be continuous and would not be differentiable at 0. Therefore, in the present invention, a polynomial fit is of the following type:

$$ECD_{RPM,Q} = F(RPM, Q) = \sum_{j \text{ `Even'}} a_j RPM^j + \sum_{i \text{ `Odd'}, j \text{ `Even'}} b_{i,j} \cdot Q^i \cdot RPM^j \tag{1}$$

where $a_j$ and $b_{ij}$ are some constants. (Alternatively, instead of a polynomial fit, an interpolation type of coverage may be used. In this case, great care must be taken to ensure the necessary symmetries hold.)

Another advantage of using a curve fitting technique with these constraints is that it enhances which terms contribute to static readings and which terms contribute to pressure friction losses. Thus, Eq. (1) may be changed into a more general equation, as follows:

$$F(RPM, Q, MD, TVD) = \sum_{j \text{ `Even'}} a_j RPM^j + \left( \sum_{i \text{ `Odd'}, j \text{ `Even'}} b_{i,j} \cdot Q^i \cdot RPM^j \right) \times \frac{TVD_{CS}}{TVD} \times \frac{MD}{MD_{CS}} \tag{2}$$

Slight changes in mud weight and viscosity can also be accounted for, provided changes in flow regime (laminar or turbulent) are insignificant. Therefore, Eq. (2) may be changed further as follows:

$$F(RPM, Q, MD, TVD, \rho_{Mud}, v_{Mud}) = (\rho_{Mud} - \rho_{Mud,0}) + \sum_{j \text{ `Even'}} a_j RPM^j + \left( \sum_{i \text{ `Odd'}, j \text{ `Even'}} b_{i,j} \cdot Q^i \cdot RPM^j \right) \times \frac{TVD_{CS}}{TVD} \times \frac{MD}{MD_{CS}} \times \frac{v_{Mud}}{v_{Mud,0}} \tag{3}$$

The section below entitled "Definitions" contains definitions of symbols and acronyms employed herein.

The "full interpolation" type of fit, i.e. the application of the present formula to all nine ECD calibration points, is:

$$ECD = F(RPM, Q) = \frac{\left\{ \begin{array}{c} f_{1,6,8}(RPM, Q) \cdot F_{1,6,8}(RPM, Q) + f_{5,7,8}(RPM, Q) \cdot F_{5,7,8}(RPM, Q) + \\ f_{4,6,9}(RPM, Q) \cdot F_{4,6,9}(RPM, Q) + f_{3,7,9}(RPM, Q) \cdot F_{3,7,9}(RPM, Q) + \\ f_{2,6,7,8,9}(RPM, Q) \cdot F_{2,6,7,8,9}(RPM, Q) \end{array} \right\}}{\sum f} \tag{4}$$

where $$f_{1,6,8} = \frac{\{(RPM - RPM_4) \cdot (Q_5) + (RPM_4) \cdot (Q)\}^2}{\{(RPM_4) \cdot (Q_5)\}^2} \quad \text{if } \{(RPM - RPM_4) \cdot (Q_5) + (RPM_4) \cdot (Q)\} \le 0$$

$$f_{5,7,8} = \frac{\{(RPM) \cdot (Q_3) - (RPM_3) \cdot (Q)\}^2}{\{(RPM_5) \cdot (Q_3) - (RPM_3) \cdot (Q_5)\}^2} \quad \text{if } \{(RPM) \cdot (Q_3) - (RPM_3) \cdot (Q)\} \le 0$$

$$f_{4,6,9} = \frac{\{(RPM) \cdot (Q_3) - (RPM_3) \cdot (Q)\}^2}{\{(RPM_4) \cdot (Q_3) - (RPM_3) \cdot (Q_4)\}^2} \quad \text{if } \{(RPM) \cdot (Q_3) - (RPM_3) \cdot (Q)\} \ge 0$$

$$f_{3,7,9} = \frac{\{(RPM - RPM_4) \cdot (Q_5) + (RPM_4) \cdot (Q)\}^2}{\{(RPM_3 - RPM_4) \cdot (Q_5) + (RPM_4) \cdot (Q_3)\}^2} \quad \text{if } \{(RPM - RPM_4) \cdot (Q_5) + (RPM_4) \cdot (Q)\} \ge 0$$

$$f_{2,6,7,8,9}(RPM, Q) = \frac{(RPM)^2 (RPM - RPM_4)^2 (Q)^2 (Q - Q_5)^2}{(RPM_2)^2 (RPM_2 - RPM_4)^2 (Q_2)^2 (Q_2 - Q_5)^2}$$

and $$F_{1,6,8}(RPM,Q) = A_{1,6,8} + B_{1,6,8} \cdot Q + C_{1,6,8} \cdot RPM^2$$

$$F_{5,7,8}(RPM,Q) = A_{5,7,8} + B_{5,7,8} \cdot Q + C_{5,7,8} \cdot RPM^2$$

$$F_{4,6,9}(RPM,Q) = A_{4,6,9} + B_{4,6,9} \cdot Q + C_{4,6,9} \cdot RPM$$

$$F_{3,7,9}(RPM,Q) = A_{3,7,9} + B_{3,7,9} \cdot Q + C_{3,7,9} \cdot RPM$$

$$F_{2,6,7,8,9}(RPM,Q) = A_{2,6,7,8,9} + B_{2,6,7,8,9} \cdot Q + C_{2,6,7,8,9} \cdot RPM + D_{2,6,7,8,9} \cdot Q^2 + E_{2,6,7,8,9} \cdot RPM_2$$

Figure 6:
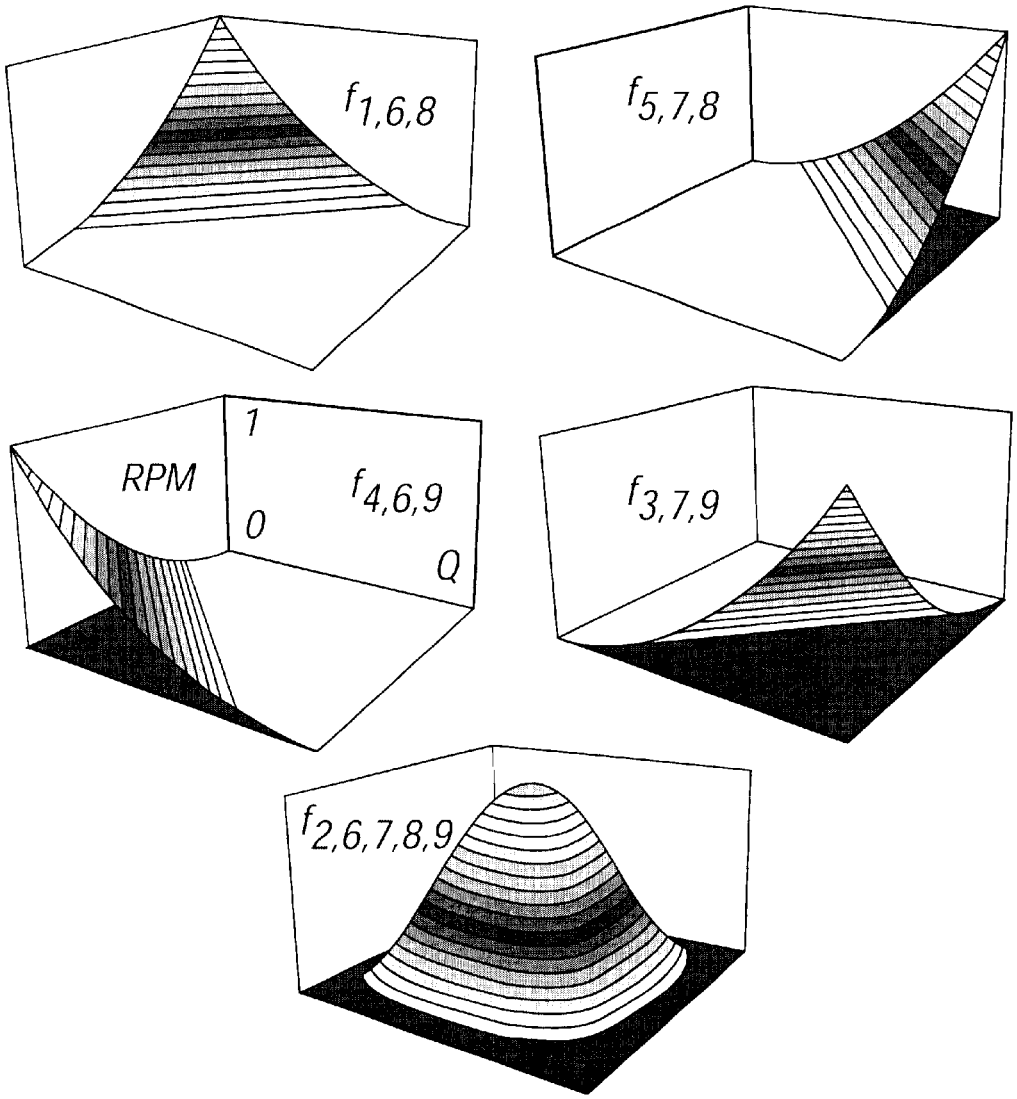
FIG. 6 depicts illustrative views of the weight functions "f" used in the ECD calibration of the present invention.

As will be understood, the weight functions "F" above are simple polynomial fits of the ECD calibration points over different regions of the intended calibration range, and the weight functions "f" above are the associated weight functions (to ensure a smooth transition from one polynomial fit to another). FIG. 6 depicts illustrative views of the five weight functions "f" used in the ECD calibration of the present invention.

The full interpolation type fit provided if curve fitting is done in accordance with Eq. (4) provides the "best" reproduction of the various ECD observed during the calibration, taking into account physics constraints (symmetries) and dividing the calibration range into five (overlapping) areas, and taking into consideration the individual areas covered by every calibration point.

Further, in the same way Eq. (1) was modified to produce Eq. (3) in order to account for changes in the wellbore geometry as drilling progresses and/or slight changes in the mud properties, Eq. (4) may also be modified to result in the following Eq. (5):

$$ECD = (\rho_{Mud} - \rho_{Mud,0}) + F(RPM, 0) + \{F(RPM, Q) - F(RPM, 0)\} \times \frac{TVD_{CS}}{TVD} \times \frac{MD}{MD_{CS}} \times \frac{v_{Mud}}{v_{Mud,0}} \tag{5}$$

Empirical Results

Figure 7:
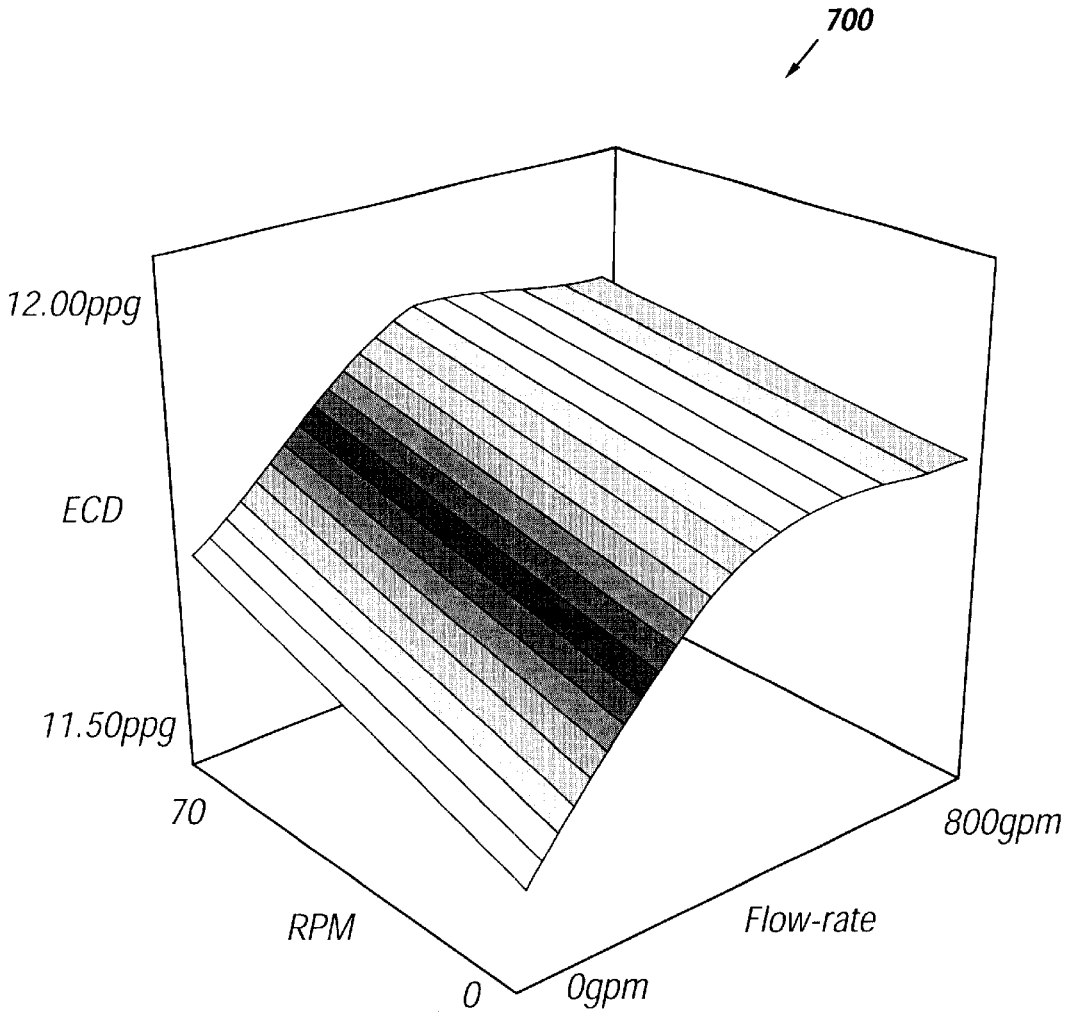
FIG. 7 shows an exemplary full interpolation between nine ECD calibration points, in accordance with an embodiment of the present invention.

Referring now to FIG. 7, there is shown an exemplary full interpolation made using nine ECD calibration points, employing Eq. (4) or (5) above, in accordance with an embodiment of the present invention. The exemplary results shown in FIG. 7 were obtained by performing the full interpolation of the present invention on some real, but not optimum, data, to verify that the interpolation works well and does not result in any abnormal spikes or other anomalous results.

The efficient ECD calibration of the present invention permits a reduction in the time required for ECD calibrations from as much as 2 hrs to as little as 20 min, and even less in some case (when less than nine calibration points are needed). This technique permits the generation of a normal ECD baseline function which permits the interpolation of ECD values in between the discrete measurements available from the ECD calibration. Further, the ECD calibration of the present invention extends the range of validity of the ECD calibration made at the casing shoe, as drilling progresses and the wellbore geometry changes and/or the mud properties undergo slight changes, such as changes in density and viscosity.

Definitions

| | |
|---|---|
| MD | Measured Depth |
| $MD_{CS}$ | MD at the Casing Shoe |
| TVD | True Vertical Depth |
| $TVD_{CS}$ | TVD at the Casing Shoe |
| $\rho_{Mud}$ | Mud weight |
| $\rho_{Mud,0}$ | Mud weight used during the BCD calibration |
| $\nu_{Mud}$ | Mud viscosity |
| $\nu_{Mud,0}$ | Mud Viscosity during the ECD calibration |
| APWD | Annular Pressure While Drilling |
| RPM | Rotations Per Minute |
| Q | Flow-rate |
| ECD | Equivalent Circulating Density |
| $RPM_{Max}$ | Maximum RPM that the client agrees to (to prevent "mechanical" damage) |
| $Q_{Max}$ | Maximum Q that the client agrees to (to prevent "mechanical" damage) |
| $ECDM_{Max}$ | Maximum ECD that the client agrees to (to prevent "hydraulic" damage) |
| $Q_{MWD}$ | Flow-rate necessary to turn on the MWD mud pulse telemetry |
| $RPM_i$ | RPMs at the various calibration points |
| $Q_i$ | Flow-rates at the various calibration points |
| $RPM_{Safe}$ | RPM that will not be exceeded during the ECD calibration |
| $Q_{Safe}$ | Flow-rate that will not be exceeded during the ECD calibration |
| $ECD_i$ | ECD measured at the various calibration points (at specific RPM and $Q_i$) |
| $ECD_i$ | ECD "fitted" at the various calibration points (after a polynomial least-square-fit) |
| Max | Required ECD accuracy as agreed with the client (typically 0.1 ppg or less) Maximum residual error between measured ECD and "fitted" ECD, defined as $Max(\lvert ECD_i - ECD'_i \rvert)$ |
| $F_{1,6,8}(RPM,Q)$ | ECD polynomial fit over the calibration points number 1,6 and 8 |
| $F_{5,7,8}(RPM,Q)$ | ECD polynomial fit over the calibration points number 5,7 and 8 |
| $F_{4,6,9}(RPM,Q)$ | ECD polynomial fit over the calibration points number 4,6 and 9 |
| $F_{3,7,9}(RPM,Q)$ | ECD polynomial fit over the calibration points number 3,7 and 9 |
| $F_{2,6,7,8,9}(RPM,Q)$ | ECD polynomial fit over the calibration points number 2,6,7,8 and 9 |
| $f_{1,6,8}(RPM,Q)$ | Weight function associated with the calibration points number 1,6 and 8 |
| $f_{5,7,8}(RPM,Q)$ | Weight function associated with the cailbration points number 5,7 and 8 |
| $f_{4,6,9}(RPM,Q)$ | Weight function associated with the calibration points number 4,6 and 9 |

-continued

| | |
|---|---|
| $f_{3,7,9}(RPM,Q)$ | Weight function associated with the calibration points number 3,7 and 9 |
| $f_{2,6,7,8,9}(RPM,Q)$ | Weight function associated with the calibration points number 2,6,7,8 and 9 |

$a_j, b_{i,j}, \rho_0, q, r_2, q_3, qr_2, A_\alpha, B_\alpha, C_\alpha, D_\alpha, E_\alpha$ are all polynomial coefficients Hydraulic Calibration The present invention has been described above with reference to calibration of ECD. As noted above, ECD is the density measure when the mud is circulating and ESD is the density measure when mud is not circulating. Thus, ESD and ECD are generically the same thing, i.e. the downhole pressure at the APWD divided by TVD. Thus, the ECD calibration of the present invention is actually a calibration of the equivalent density measure in general, i.e. calibration of both ECD and ESD.

As described above, downhole annular pressure, and thus ECD, are difficult to model because it depends on known factors such as RPM and Q, and also on other factors, such as mud properties, drill-pipe eccentricity, and hole geometry, that are unpredictable and/or difficult to model. Accordingly, the calibration of the present invention may be used to calibrate not only ECD but also downhole pressure and any other hydraulic or pressure-related measure which depends on RPM and/or flow-rate as well as on other unpredictable or difficult-to-model factors or conditions.

Thus, in an alternative embodiment, the present invention provides for hydraulic calibration with respect to any hydraulic measure which is a function of RPM and/or flow-rate. Such hydraulic measures include pressure itself, such as downhole pressure or standpipe pressure, and other measures such as ECD that are derived from or are a function of such pressure measurements. Thus, the hydraulic calibration techniques described herein may be used to establish a baseline function for ECD, for downhole pressure, or for standpipe pressure.

Standpipe pressure is the pressure of the mud fluid being pumped inside the drillpipe at the surface, as measured by a sensor just after the mud pumps at the surface. Standpipe pressure is also an important indicator during drilling, which is useful in diagnosing and detecting problems in the early stages before they develop into serious problems. Like ECD and downhole pressure, normal standpipe pressure cannot always be reliably modeled. Therefore, using the calibration techniques described above, a standpipe pressure baseline function may be developed, which plots normal or expected standpipe pressure versus RPM and/or flow-rate, to which the real-time standpipe pressure may be compared during drilling at a given RPM and flow-rate.

In alternative embodiments, the hydraulic calibration of the present invention may be used to calibrate other hydraulic or pressure-related measures that depend on RPM and/or Q, such as Turbine RPM (TRPM) and Internal Pressure While Drilling (IPWD). TRPM depends strongly on Q, and to a much lesser extent on RPM, and may be calibrated by transforming it into a mud flow-rate. IPWD pressure also depends strongly on Q, and to a much lesser extent on RPM.

The hydraulic baseline function developed in accordance with the present invention may be used to analyze and monitor the respective hydraulic measurements during subsequent drilling. In particular, if the current hydraulic measurement is too high or too low, in comparison to the expected hydraulic measurement as determined by the hydraulic baseline function, corrective or other responsive steps may be taken. Thus, after a given hydraulic calibration, subsequent hydraulic measurements are made during drilling, each at a respective drill-string RPM and flow-rate. For each such current hydraulic measurement, an expected hydraulic measurement at the current drill-string RPM and flow-rate is determined, using the hydraulic baseline function. The current hydraulic measurement is compared to the expected hydraulic measurement to determine whether the difference therebetween exceeds a predetermined threshold. If so, steps can be taken to correct the problem. Hydraulic calibration may be repeated as often as necessary, e.g. every several hours of drilling or whenever conditions change substantially.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. In a drilling system for drilling a well borehole from a surface location, a method for hydraulic calibration, comprising the steps of:

(a) making a plurality of hydraulic calibration measurements, each hydraulic calibration measurement being made at a respective drillstring RPM and flow-rate within a hydraulic calibration range; and (b) determining a hydraulic baseline function that predicts, to within a predetermined degree of accuracy, each of the plurality of hydraulic calibrations measurements.

2. The method of claim 1, further comprising the steps of:

(c) making a subsequent hydraulic measurement during drilling, at a respective drill-string RPM and flow-rate;

(d) determining, with the hydraulic baseline function, an expected hydraulic measurement at the drill-string RPM and flow-rate; and (e) comparing the subsequent hydraulic measurement to the expected hydraulic measurement to determine whether the difference therebetween exceeds a predetermined threshold.

3. The method of claim 1, wherein:

each hydraulic calibration measurement is an equivalent density calibration measurement;

the hydraulic calibration range is a equivalent density calibration range; and the hydraulic baseline function is an equivalent density baseline function.

4. The method of claim 3, wherein a hydraulic calibration measurement is made by performing a downhole annular pressure measurement and dividing the measured downhole pressure by the true vertical depth at which the pressure measurement is made.

5. The method of claim 1, wherein the plurality of hydraulic calibration measurements are spaced within the hydraulic calibration range to cover the vertices of the hydraulic calibration range and centers of gravity of the hydraulic calibration range and of sub-regions defined by said calibration measurements.

6. The method of claim 1, wherein the hydraulic baseline function is a function of drill-string RPM and flow-rate Q, where the function is even in RPM and odd in Q.

7. The method of claim 1, wherein step (a) comprises the steps of:

(1) making the plurality of hydraulic calibration measurements in accordance with an ordering in which each hydraulic calibration measurement at a flow-rate insufficient to permit mud-pulse telemetry is followed by a hydraulic calibration measurement at a flow-rate sufficient to permit mud-pulse telemetry;

(2) storing in a memory in the borehole each hydraulic calibration measurement at a flow-rate insufficient to permit mud-pulse telemetry; and (3) during a current hydraulic calibration measurement at a flow-rate sufficient to permit mud-pulse telemetry, transmitting from the borehole to the surface, via mud-pulse telemetry, a hydraulic calibration measurement stored in memory and the current hydraulic calibration measurement.

8. The method of claim 7, comprising the further step of:

(4) after the first two hydraulic calibration points are measured, making subsequent hydraulic calibration point measurements, generating the hydraulic baseline function based on the hydraulic calibration points already measured and comparing a residual fit of the hydraulic baseline function to the residual fit threshold, and repeating said generating and comparing until the residual fit is less than the residual fit threshold or until all of the hydraulic calibration points have been measured.

9. The method of claim 1, wherein steps (a) and (b) comprises the steps of:

(1) making a first hydraulic calibration measurement at the origin of the hydraulic calibration range and storing the first hydraulic calibration measurement in a memory in the borehole, wherein the first hydraulic calibration measurement flow-rate is insufficient to permit mud-pulse telemetry, making a second hydraulic calibration measurement at or near the center of gravity of the hydraulic calibration range, wherein the second hydraulic calibration measurement flow-rate is sufficient to permit mud-pulse telemetry, and transmitting to the surface, via mud-pulse telemetry, the first hydraulic calibration measurement stored in the memory and the second hydraulic calibration measurement;

(2) determining at the surface, based on the first and second hydraulic calibration measurements, a maximum safe RPM and a maximum safe flow-rate, which define the hydraulic calibration range;

(3) making a third hydraulic calibration measurement at the maximum safe RPM and the maximum safe flow-rate, transmitting the third hydraulic calibration measurement to the surface via mud-pulse telemetry, and generating the hydraulic baseline function based on the first three hydraulic calibration points; and (4) if a residual fit of the hydraulic baseline function to the first three hydraulic calibration points is greater than a residual fit threshold, then making a fourth hydraulic calibration measurement at a flow-rate of zero and at the maximum safe RPM and storing the fourth hydraulic calibration measurement in the memory, making a fifth hydraulic calibration measurement at the maximum safe flow-rate and at an RPM of zero, transmitting to the surface, via mud-pulse telemetry, the fourth hydraulic calibration measurement stored in the memory and the fifth hydraulic calibration measurement, and generating the hydraulic baseline function based on the first five hydraulic calibration points.

10. The method of claim 9, wherein steps (a) and (b) further comprise the steps of:

(5) if the residual fit of the hydraulic baseline function to the first five hydraulic calibration points is greater than the residual fit threshold, then making a sixth hydraulic calibration measurement at a center of gravity of a west region of the calibration region and storing the sixth hydraulic calibration measurement in the memory, making a seventh hydraulic calibration measurement at a center of gravity of an east region of the calibration region, transmitting to the surface, via mud-pulse telemetry, the sixth hydraulic calibration measurement stored in the memory and the seventh calibration measurement, and generating the hydraulic baseline function based on the first seven hydraulic calibration points;

(6) if the residual fit of the hydraulic baseline function to the first seven hydraulic calibration points is greater than the residual fit threshold, then making an eight hydraulic calibration measurement at a center of gravity of a north region of the calibration region, transmitting the eight hydraulic calibration measurement to the surface via mud-pulse telemetry, taking a ninth hydraulic calibration measurement at a center of gravity of a south region of the calibration region, transmitting the ninth hydraulic calibration measurement to the surface via mud-pulse telemetry, and generating the hydraulic baseline function based on all nine hydraulic calibration points.

* * * * *